US009109595B2

(12) United States Patent
Daunheimer

(10) Patent No.: US 9,109,595 B2
(45) Date of Patent: Aug. 18, 2015

(54) HELICAL GEAR PUMP

(76) Inventor: Ralf Daunheimer, Schembeck (DE)

( * ) Notice: Subject to any disclaimer, the term of this patent is extended or adjusted under 35 U.S.C. 154(b) by 219 days.

(21) Appl. No.: 13/203,268

(22) PCT Filed: Mar. 2, 2010

(86) PCT No.: PCT/EP2010/052597

§ 371 (c)(1),
(2), (4) Date: Aug. 25, 2011

(87) PCT Pub. No.: WO2010/100134

PCT Pub. Date: Sep. 10, 2010

(65) Prior Publication Data

US 2011/0305589 A1 Dec. 15, 2011

(30) Foreign Application Priority Data

Mar. 2, 2009 (DE) ..... 20 2009 002 823 U

(51) Int. Cl.
*F01C 1/16* (2006.01)
*F04C 2/107* (2006.01)

(52) U.S. Cl.
CPC ..... *F04C 2/1071* (2013.01); *F04C 2230/91* (2013.01); *F04C 2240/10* (2013.01); *F04C 2240/20* (2013.01); *F04C 2250/201* (2013.01)

(58) Field of Classification Search
CPC .... F01C 1/101; F04C 2/1071; F04C 18/1075; F04C 2230/91; F04C 2250/201; F04C 2240/20; F04C 2/107; F04C 2/1075
USPC ..... 418/1, 48, 201.1, 152–153, 182
See application file for complete search history.

(56) References Cited

U.S. PATENT DOCUMENTS 1,892,217 A * 12/1932 Moineau ..... 74/458
2,085,115 A * 6/1937 Moineau ..... 74/466
2,290,137 A * 7/1942 Aldridge ..... 418/48
2,532,145 A * 11/1950 Byram ..... 418/48

(Continued)

FOREIGN PATENT DOCUMENTS

DE 633784 9/1936
DE 2736590 8/1977

(Continued)

*Primary Examiner* — Thai Ba Trieu
*Assistant Examiner* — Jason T Newton
(74) *Attorney, Agent, or Firm* — Karl F. Milde, Jr.; Eckert Seamans Cherin & Mellott, LLC

(57) ABSTRACT

The invention relates to an eccentric screw pump (100), in particular for conveying viscous, highly viscous and abrasive media, having a longitudinal direction L, having a conical, helically wound, at least single-start rotor (1) having a gradient h, having at least one eccentricity ($e_1, e_2, e_3, \ldots e_n$) and at least one cross-section d that is rotatably arranged in a single or multi-start conical stator (2) wherein a plurality of chambers (3, 4, 5 . . . n) each having a volume ($V_3, V_4, V_5 \ldots V_n$) is formed between the rotor (1) and stator (2) that serve to convey the medium and wherein the chambers (3, 4, 5 . . . n) between the stator and the rotor are limited by a sealing line D. The volumes ($V_3, V_4, V_5 \ldots V_n$) of each individual chamber (3, 4, 5 . . . n) between the stator (2) and the rotor (1) are equal.

5 Claims, 7 Drawing Sheets

(56) References Cited

U.S. PATENT DOCUMENTS

| | | | | | |
|---|---|---|---|---|---|
| 2,553,548 | A * | 5/1951 | Pawl et al. | 123/241 |
| 2,733,854 | A * | 2/1956 | Chang | 418/48 |
| 2,957,427 | A * | 10/1960 | O'Connor | 418/48 |
| 3,771,900 | A * | 11/1973 | Baehr | 415/72 |
| 3,779,521 | A * | 12/1973 | Godines | 366/79 |
| 4,648,796 | A * | 3/1987 | Maghenzani | 415/218.1 |
| 4,863,357 | A * | 9/1989 | Olofsson | 417/356 |
| 5,120,204 | A * | 6/1992 | Mathewson et al. | 418/48 |
| 5,358,390 | A * | 10/1994 | Jager | 418/48 |
| 5,722,820 | A * | 3/1998 | Wild et al. | 418/48 |
| 6,220,837 | B1 * | 4/2001 | Naylor | 418/1 |
| 6,354,824 | B1 * | 3/2002 | Mills | 418/152 |
| 6,457,958 | B1 * | 10/2002 | Dunn | 418/1 |
| 2009/0214369 | A1 * | 8/2009 | Brun et al. | 418/48 |
| 2010/0260636 | A1 * | 10/2010 | Grann et al. | 418/48 |

FOREIGN PATENT DOCUMENTS

| | | | | |
|---|---|---|---|---|
| EP | 1503034 | A1 * | 2/2005 | F01C 1/07 |
| EP | 1988288 | A1 * | 11/2008 | F04C 2/107 |
| GB | 441246 | | 5/1935 | |
| WO | WO 2008000505 | A1 * | 1/2008 | |
| WO | WO 2009/056200 | A1 * | 5/2009 | F04C 2/107 |

* cited by examiner $e_n$

HELICAL GEAR PUMP

BACKGROUND OF THE INVENTION

The invention relates to an eccentric screw pump, also known as a "helical gear pump", in particular for conveying viscous, highly viscous and abrasive media, having a longitudinal direction L, exhibiting at least one conical, helically wound, at least single-start rotor having a pitch h, having at least one eccentricity e and at least one cross-section d that is rotatably arranged in a single or multi-start conical stator. A plurality of chambers, each having a volume formed between the rotor and the stator, serve to convey the medium. These chambers between the stator and the rotor are delimited by a sealing line D. Furthermore, the invention relates to an eccentric screw pump, in particular for conveying viscous, highly viscous and abrasive media, having a longitudinal direction L, exhibiting at least one stepped, helically wound, at least single-start rotor having a pitch h, having at least one eccentricity e and at least one cross-section d that is rotatably arranged in a single or multi-start stepped stator.

Eccentric screw (helical gear) pumps are quite well known in the art. The German Patent No. DE 633,784 describes an eccentric screw pump in which two helical elements are intertwined. The outer element has one more worm threads or teeth than the inner element and the pitches of the worm threads of the two elements behave like the thread or tooth numbers, that, however, can be either constant, increasing or decreasing. At least three interacting spiral-shaped elements are provided, of which the middle one has one tooth more than the inner one and one tooth less than the outer one.

Known from the German Patent Publication No. DE 27 36 590 A1 is an eccentric screw pump with a conical screw shaft and a housing insert, which is characterized by the fact that the eccentric screw shaft has a round, cylindrical base cross-section and a conically increasing tapered outer diameter. The conically wound, inner hollow screw with twice the pitch of the eccentric screw shaft causes a tapered hypocycloidal rolling off on the eccentric screw shaft on the inside surface of the conical, wound hollow screw.

The problem with eccentric screw pumps of the prior art that have multiple chambers is that so-called "cavitations" may occur, caused by increases in the chamber volume due to wear, with the result that the conveying capacity of such eccentric screw pumps does not remain optimal.

SUMMARY OF THE INVENTION

It is therefore a principal objective of the present invention to provide an eccentric screw pump that can be adjusted easily in case of wear, such that an optimum pump performance can be expected at all times and a replacement of the stator and/or rotor is required less often.

The objective, as well as further objectives which will become apparent from the discussion that follows, are achieved, according to the present invention, by providing an eccentric screw pump in which the volumes of the chambers between stator and rotor are equal in size.

This inventive design of an eccentric screw pump makes it possible that the pump will always exhibit the maximum possible conveying capacity. If there are any signs of wear, the rotor shaft and/or the stator can, for example, be moved in the longitudinal direction such that the chamber volumes are again equal and the pumping performance of the eccentric screw pump is optimal.

The invention provides that the cross-section d of the rotor decreases in the longitudinal direction of the rotor. A constant chamber volume can be maintained via the decrease of the cross section, for example, with a changing change of the eccentricity.

In addition, other embodiments are possible, namely that the pitch h of the rotor decreases with a decreasing cross-section d of the rotor and that the rotor exhibits a decreasing cross-section d in the longitudinal direction L. It is also possible that the eccentricity e of the rotor increases or decreases in the longitudinal direction L and that the cross-section d of the rotor decreases or increases. Furthermore, the eccentric screw pump according to the invention can be designed such that the eccentricity of the rotor increases or decreases in the longitudinal direction and the pitch h of the rotor increases or decreases in the longitudinal direction.

It is also possible that in an eccentric screw pump according to the invention, the eccentricity of the rotor increases or decreases in the longitudinal direction L, the pitch h of the rotor increases or decreases in the longitudinal direction L and that the rotor exhibits a decreasing or increasing cross-section d in the longitudinal direction. Through varying the parameters described above, the pumping performance of the eccentric screw pump according to the invention can be optimized further, or adapted to the respective requirements as specified based on the goods to be conveyed, for example.

In addition, due to these variation options it is possible to provide eccentric screw pumps for various fields of application, namely applications where viscous, highly viscous and/or abrasive media must be transported.

To increase the service life of the eccentric screw pump according to the invention, the rotor may exhibit a coating containing chrome, for example, with a ceramic material or other materials for wear protection.

The invention provides that the stator and/or rotor may be made of an elastomeric or a solid material. Here too the option exists to provide the respective material for the stator and/or rotor of the eccentric screw pump according to the invention depending on the intended application.

Advantageously, the stator may also exhibit a ring or tube-shaped stator shell that is made of a different material. This stator shell can be employed to protect the stator and thus to increase the service life of the eccentric screw pump. Advantageously, such a stator exhibits a tapered shape.

According to the invention, it is further provided that the stator has a uniform plastic wall thickness.

For a full understanding of the present invention, reference should now be made to the following detailed description of the preferred embodiments of the invention as illustrated in the accompanying drawings.

DESCRIPTION OF THE PREFERRED EMBODIMENTS

Figure 1A:
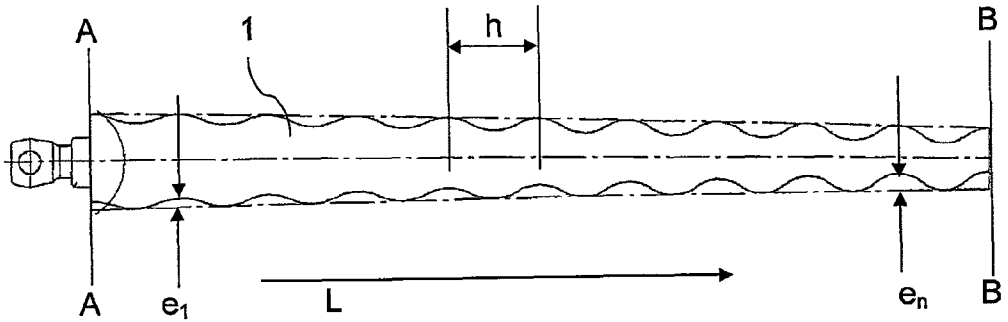
FIG. 1*a* is a longitudinal section through the rotor of an eccentric screw pump according to the invention.

The preferred embodiments of the present invention will now be described with reference to FIGS. 1-7*c* of the drawings. Identical elements in the various figures are designated with the same reference numerals.

Figure 1C:
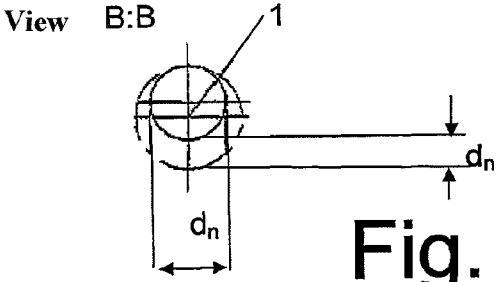
FIG. 1*c* is an additional view of a rotor of an eccentric screw pump according to the invention at position B.
Figure 1B:
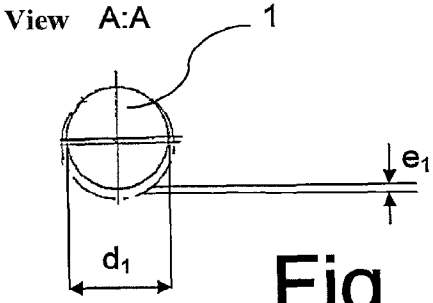
FIG. 1*b* is a view of the rotor of an eccentric screw pump according to the invention at position A.

FIG. 1 shows a rotor 1 of an eccentric screw pump according to the invention in a longitudinal section. The rotor 1 exhibits a pitch h as well as an eccentricity $e_1$ at the beginning of the rotor 1 and an eccentricity $e_n$ at the end of the rotor 1. In the longitudinal direction L of the rotor 1 the eccentricity of the rotor 1 increases such that the dimension $e_n$ is greater than the dimension $e_1$. FIG. 1*b* shows the view A:A onto the beginning of the end of the rotor 1. The rotor 1 exhibits a cross-section $d_1$ and the eccentricity $e_1$, which is recognizable in this view as well. FIG. 1*c* shows the view B:B of FIG. 1*a*, in which it is apparent that the cross-section $d_n$ at the end of the rotor 1 is smaller than the cross-section $d_1$ at the beginning of the rotor 1. It is also recognizable that the eccentricity increases in the longitudinal direction L of the rotor 1.

Figure 2:
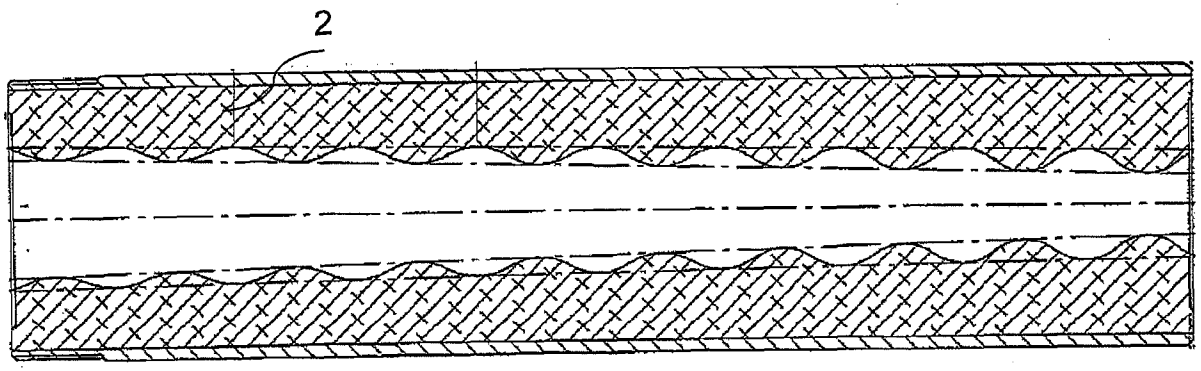
FIG. 2 is a longitudinal section through an eccentric screw pump according to the invention.

FIG. 2 shows the stator 2 of an eccentric screw pump according to the invention. The previously described rotor 1 of FIG. 1*a* can be inserted into this stator 2, thus forming the eccentric screw pump according to the invention, which is characterized in that the individual volumes that are available for transporting the medium are equal in size in the longitudinal direction L of the rotor. The longitudinal view of FIG. 2 clearly demonstrates the tapering of the stator as well as that of the rotor, which fits into said stator. Due to the tapering of stator 2 and rotor 1 and the respective settings of pitch, cross-section and/or eccentricity, it is possible to keep the individual volumes of the chambers located in the eccentric screw pump according to the invention constant.

Figure 3A:
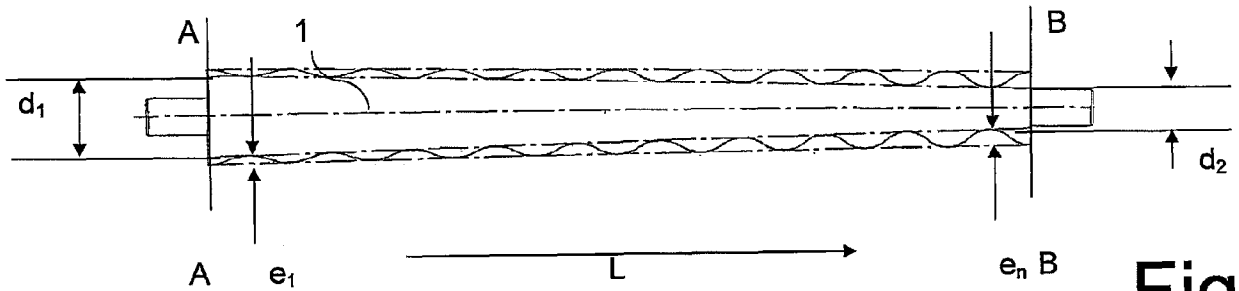
FIG. 3*a* is a longitudinal section through an additional embodiment of the eccentric screw pump according to the invention.
Figure 3C:
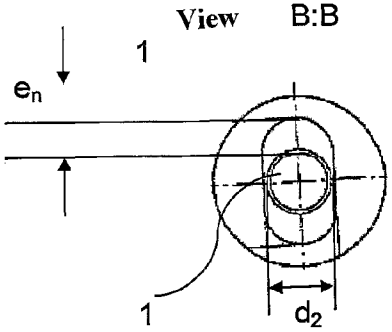
FIG. 3*c* is a view of the rotor onto the rotor of an eccentric screw pump according to the invention at position B.
Figure 3B:
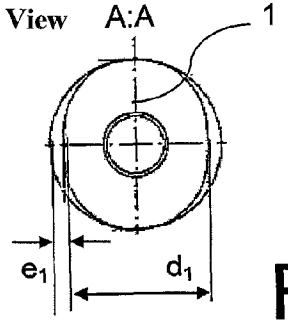
FIG. 3*b* is a view of the rotor of an eccentric screw pump according to the invention at position A.

FIGS. 3*a*, 3*b* and 3*c* show a further embodiment of a rotor 1, which can be inserted into an eccentric screw pump according to the invention. At its beginning (view A:A), the rotor 1 exhibits a cross-section $d_1$, which is larger than the cross-section of the rotor 1 at its end (view B:B) and is designated with $d_2$. A decrease in the cross-section of rotor 1 resulting in a conical shape of the rotor 1 can be recognized along the longitudinal direction L of the rotor 1. The eccentricity e of the rotor begins at the start of the rotor 1 (position A) with a size of $e_1$ and ends at position B with a maximum value of $e_n$. Thus, the eccentricity e increases in the longitudinal direction of the rotor 1, i.e., from the larger cross-section to the smaller cross-section d. FIGS. 3*b* and 3*c* show the respective views A:A and B:B that enable the top view onto the end or the beginning, respectively of the rotor 1. From FIG. 3*b* it can be seen that the eccentricity $e_1$ at the beginning of the rotor 1, at the location A with the cross-section $d_1$ is clearly smaller than the eccentricity $e_n$, which is visible in FIG. 3*c* presenting a view (view B:B) onto the end of the rotor. FIG. 3*c* also demonstrates that the cross-section $d_2$ is smaller than the cross-section $d_1$ as well.

Figure 4A:
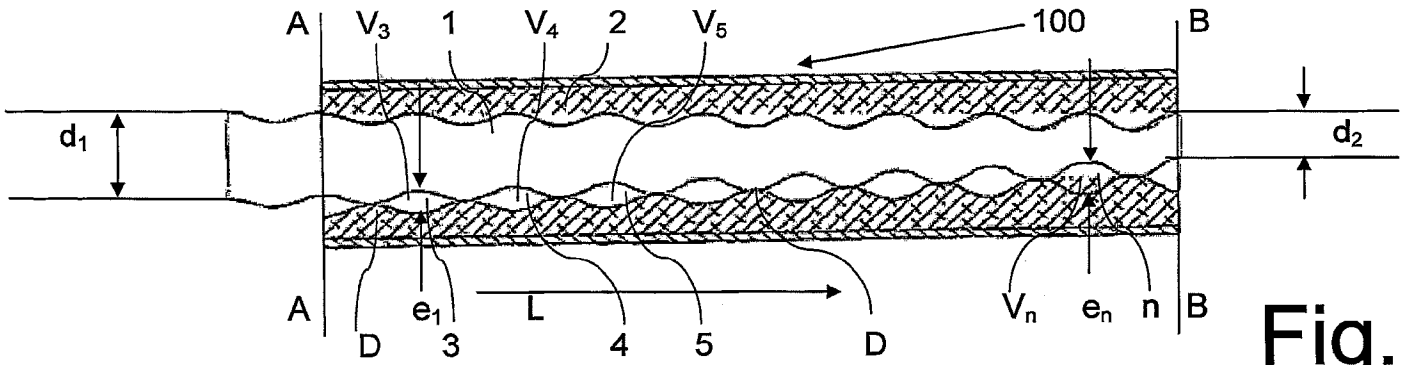
FIG. 4*a* is a longitudinal section through rotor and stator of an eccentric screw pump according to the invention.
Figure 4C:
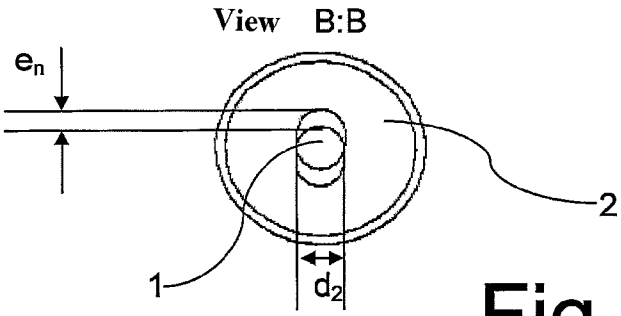
FIG. 4*c* is a view of an eccentric screw pump according to the invention at position B.
Figure 4B:
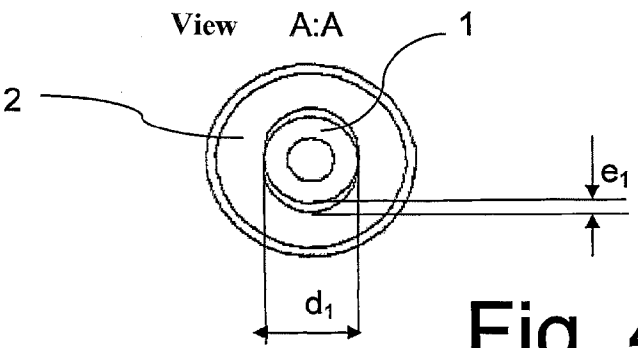
FIG. 4*b* is a view of an eccentric screw pump according to the invention at position A.

Shown in FIG. 4*a* is an eccentric screw pump 100 according to the invention that exhibits a rotor 1 and a stator 2. Various chamber volumes $V_3$, $V_4$, $V_5$ . . . $V_n$ of the chambers 3, 4, 5 . . . n, all of which are of the same size can be recognized between rotor 1 and stator 2. The equal size of the volumes listed above is a result of the fact that the rotor 1 exhibits both a predetermined tapering and an eccentricity, pitch and/or cross-section of the rotor 1 adapted to it, said rotor being surrounded by a correspondingly shaped stator 2. In order to have a liquid abrasive and/or highly viscous medium transported by the eccentric screw pump 100, a sealing line D is formed between the stator 2 and the rotor 1, along which the necessary pressure is generated that is necessary to transport the abrasive, highly viscous medium under pressure through the eccentric screw pump 100. Due to the rotational movement of the rotor 1 said sealing line moves essentially in the form of a spiral along the longitudinal direction L in the direction of the outlet of the eccentric screw pump 100 according to the invention and moves the medium to be transported in the direction of the pump outlet. The medium to be transported, which is located within the volumes, is moved in the direction of the outlet of the eccentric screw pump 100 according to the invention. The eccentric screw pump 100 according to the invention can be driven, for example, by an electric motor that is located at the end (position A) of the eccentric screw pump according to the invention, which exhibits the cross-section $d_1$ and turns the rotor 1 at this location. Also apparent from FIG. 4*a* is the fact that the cross-section $d_1$ at the beginning of the rotor 1 is greater than the cross-section $d_2$ at the end of the rotor 1. This entails that the eccentricity of the eccentric screw pump 100 according to the invention at the beginning, i.e., in the region of the inlet into the eccentric screw pump (position A) is smaller than at the end (position B), i.e., towards the outlet end of the medium of the eccentric screw pump 100. The eccentricity at the inlet of the eccentric screw pump (position A) is designated with $e_1$ and the eccentricity at the outlet (position B) of the eccentric screw pump 100 according to the invention is designated with $e_n$. The views onto the inlet region or the outlet region, respectively, of the eccentric screw pump 100 according to the invention, which are shown in FIGS. 4*b* and 4*c* also indicate once more clearly that the eccentricity in the longitudinal direction L of the eccentric screw pump 100 according to the invention, or in the longitudinal direction L of the rotor 1, respectively, increases such that $e_1$ is smaller than $e_n$. Accordingly, the cross-section $d_1$ at the beginning of the rotor is greater than the cross section $d_2$ of the rotor 1 in the end region of the eccentric screw pump 100. FIGS. 4*a* to 4*c* show an eccentric screw pump 100 for which both the cross-section of the rotor 1 and the eccentricity e of the rotor 1 have been changed.

Figure 5A:
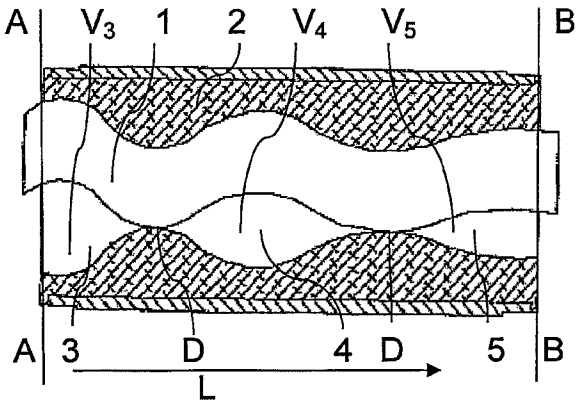
FIG. 5*a* is a longitudinal section through an eccentric screw pump according to an additional embodiment of the invention.
Figure 5C:
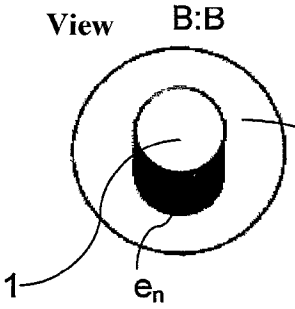
FIG. 5*c* is a view of an eccentric screw pump according to the invention at position B.
Figure 5B:
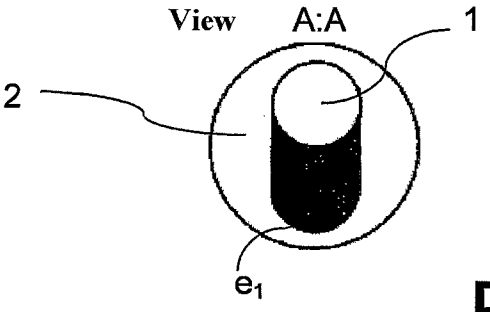
FIG. 5*b* is a view of an eccentric screw pump according to the invention at position A.
Figure 6A:
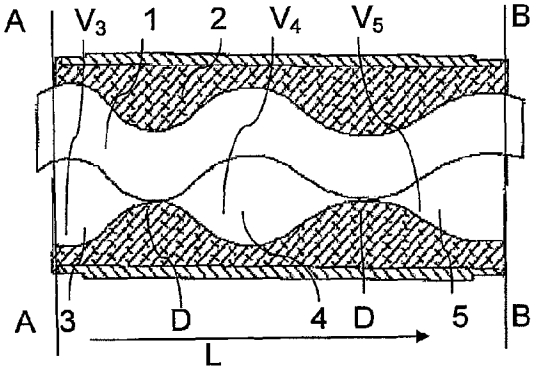
FIG. 6*a* is a longitudinal section through an additional embodiment of the eccentric screw pump according to the invention.
Figure 6C:
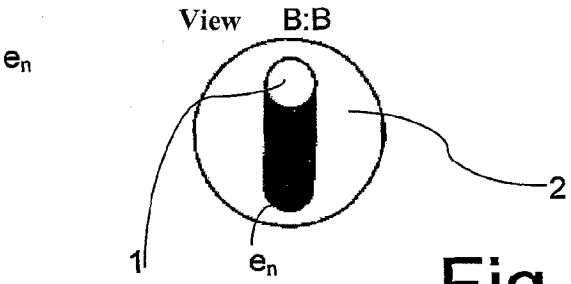
FIG. 6*c* is a view of an eccentric screw pump according to the invention at position B.
Figure 6B:
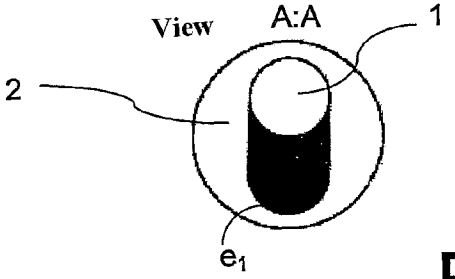
FIG. 6*b* is a view of an eccentric screw pump according to the invention at position A.

FIGS. 5*a* to 5*c* show a further possible embodiment of the eccentric screw pump 100 according to the invention, which differs from the eccentric screw pump 100 shown in FIGS. 4*a* to 4*c* in that the cross-section $d_1$ of the rotor 1 is not altered in the longitudinal direction L of the rotor 1. In order to still keep the volumes $V_3$, $V_4$, $V_5$, to $V_n$ at an equal size, the pitch h of the rotor or of the stator, respectively has been changed in this embodiment of an eccentric screw pump 100 according to the invention in the longitudinal direction L of the eccentric screw pump according to the invention. In particular, FIG. 5*a* shows that the pitch h decreases in the longitudinal direction L of the eccentric screw pump 100 according to the invention. FIGS. 5*b* and 5*c* show the views along the line A:A or B:B, respectively from FIG. 5*a*, namely the views onto the inlet end or the outlet end, respectively, of this embodiment of the eccentric screw pump 100 according to the invention. It becomes apparent that the eccentricity $e_1$ at the inlet end of the eccentric screw pump is greater than the eccentricity $e_n$ in the outlet region. FIGS. 6*a* to 6*c* also show a further embodiment of the eccentric screw pump 100 according to the invention, which differs from the eccentric screw pump shown in FIGS. 4*a* to 4*c* in that in this embodiment, both the cross-section and the pitch of the rotor or the stator, respectively, were changed.

In particular, FIGS. 6*b* and 6*c* demonstrate that the cross-section of rotor 1 in the inlet region of the eccentric screw pump is greater than the cross-section of rotor 1 in the outlet region of the eccentric screw pump.

Figure 7A:
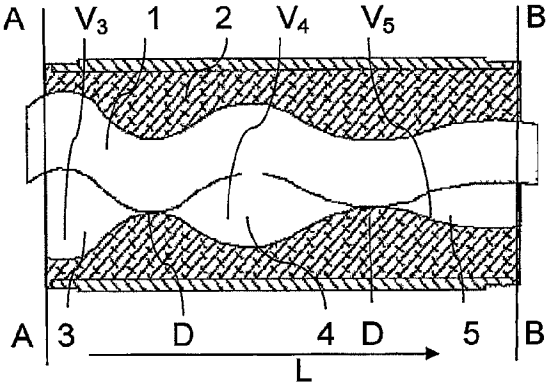
FIG. 7*a* is a longitudinal section through an additional embodiment of an eccentric screw pump according to the invention.
Figure 7C:
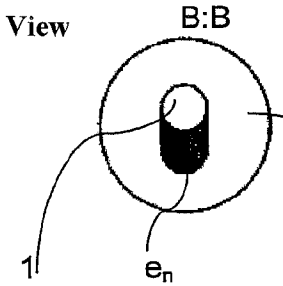
FIG. 7*c* is a view of an eccentric screw pump according to the invention at position B.
Figure 7B:
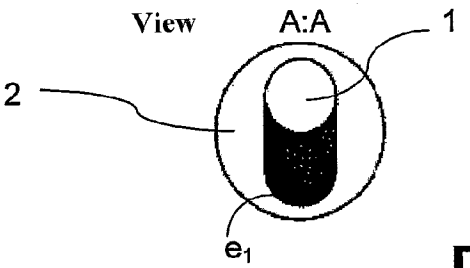
FIG. 7*b* is a view of an eccentric screw pump according to the invention at position.

FIGS. 7*a* to 7*c* show a further variant of the eccentric screw pump according to the invention, in which the eccentricity, the diameter and the pitch of the rotor or stator, respectively, were changed, with the individual volumes $V_3$, $V_4$, $V_5$ being held constant. In particular, FIG. 7*a* demonstrates that the pitch h decreases in the longitudinal direction L of the eccentric screw pump according to the invention. The change in terms of the cross section of rotor 1 and the eccentricity e are shown in FIGS. 7*b* and 7*c*.

There has thus been shown and described a novel eccentric screw pump which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. An eccentric screw pump for conveying a medium along a longitudinal direction (L), said eccentric screw pump comprising:

(1) a rotor having at least one conical, helically wound thread with a pitch (h), having at least one eccentricity ($e_1$, $e_2$, $e_3$, . . . $e_n$) and a circular cross-section (d);

(2) a stator having a conical thread, said rotor being rotatably arranged within said stator along said longitudinal direction (L) of the screw pump; and (3) a plurality of chambers, each having a volume ($V_3$, $V_4$, $V_5$ . . . $V_n$), formed between the rotor and the stator, to convey the medium;

wherein the plurality of chambers between the stator and the rotor are delimited by a sealing line (D);

wherein one of: (a) the at least one eccentricity ($e_1$, $e_2$, $e_3$, . . . $e_n$) of the rotor increases and the cross-section (d) of the rotor decreases in the longitudinal direction (L), and (b) the at least one eccentricity ($e_1$, $e_2$, $e_3$, . . . $e_n$) of the rotor decreases and the cross-section (d) of the rotor increases in the longitudinal direction (L); and wherein the eccentric screw pump is adjustable by longitudinal displacement of the rotor with respect to the stator, whereby the volumes ($V_3$, $V_4$, $V_5$ . . . $V_n$) of each individual chamber between stator and rotor are equal in size.

2. An eccentric screw pump as set forth in claim 1, wherein the pitch (h) of the rotor decreases in the longitudinal direction (L) of the rotor.

3. An eccentric screw pump as set forth in claim 1, wherein the pitch (h) of rotor decreases with a decreasing cross-section (d) of the rotor and wherein the rotor exhibits a decreasing cross-section (d) in the longitudinal direction (L).

4. An eccentric screw pump as set forth in claim 1, wherein the at least one eccentricity ($e_1$, $e_2$, $e_3$, . . . $e_n$) of the rotor increases or decreases in the longitudinal direction (L) and the pitch (h) of the rotor increases or decreases, respectively, in the longitudinal direction (L).

5. An eccentric screw pump as set forth in claim 1, wherein the at least one eccentricity ($e_1$, $e_2$, $e_3$, . . . $e_n$) of the rotor increases or decreases in the longitudinal direction (L) and the pitch (h) of the rotor increases or decreases, respectively, in the longitudinal direction (L), and wherein the rotor exhibits a decreasing or increasing cross-section (d), respectively, in the longitudinal direction (L).

* * * * *